United States Patent [19]

Singletary, Jr.

[11] Patent Number: 4,598,834

[45] Date of Patent: Jul. 8, 1986

[54] FLEXIBLE STERILE CLOSURE SYSTEM FOR A CONTAINER WITH A SIDE INJECTION PORT

[75] Inventor: Winfield S. Singletary, Jr., Garland, Tex.

[73] Assignee: U.S. Clinical Products, Inc., Richardson, Tex.

[21] Appl. No.: 698,917

[22] Filed: Feb. 6, 1985

[51] Int. Cl.[4] ..... B65D 41/32

[52] U.S. Cl. ..... 215/232; 156/69; 156/268; 53/425; 215/254; 215/249; 383/5; 150/52 R

[58] Field of Search ..... 215/232, 246, 254, 249, 215/251; 150/8; 156/69, 268, 277; 383/5, 42; 53/425; 220/359, 257, 270; 229/43; 128/272

[56] References Cited

U.S. PATENT DOCUMENTS

| | | |
|---|---|---|
| 1,916,977 | 7/1933 | Gutmann . |
| 2,373,847 | 4/1945 | Osborne et al. . |
| 2,876,775 | 3/1959 | Barr, Sr. et al. . |
| 2,878,808 | 3/1959 | Roman . |
| 2,886,198 | 5/1959 | Herter . |
| 3,064,652 | 11/1962 | Corcoran et al. . |
| 3,391,847 | 7/1968 | Christine et al. . |
| 3,463,339 | 8/1969 | McGuckin . |
| 3,501,042 | 3/1970 | Risch et al. . |
| 3,637,102 | 1/1972 | Shaw . |
| 3,712,498 | 1/1973 | Lawrence . |
| 3,788,374 | 1/1974 | Saijo . |
| 3,904,060 | 9/1975 | McPhee . |
| 3,921,630 | 11/1975 | McPhee . |
| 4,006,839 | 2/1977 | Thiel et al. . |
| 4,089,432 | 5/1978 | Crankshaw et al. . |
| 4,131,211 | 12/1978 | Corbic . |
| 4,209,126 | 6/1980 | Elias . |
| 4,266,687 | 5/1981 | Cummings . |
| 4,318,490 | 3/1982 | Schneider . |
| 4,390,104 | 6/1983 | Cummings . |
| 4,423,819 | 1/1984 | Cummings . |
| 4,514,248 | 4/1985 | Cummings . |
| 4,527,703 | 7/1985 | Cummings . |

FOREIGN PATENT DOCUMENTS

| | | |
|---|---|---|
| 201082 | 2/1956 | Australia . |
| 500032 | 2/1954 | Canada . |
| 2753239 | 6/1979 | Fed. Rep. of Germany . |
| 2922047 | 12/1979 | Fed. Rep. of Germany . |

OTHER PUBLICATIONS

Pharmacy and Stock Label Handout, undated.

EM-ETTES Label Cups and Caps Advertisement.

Emblem-Medic Industries Ad, p. 1257, Oct. 1978, *American Journal of Hospital Pharmacy.*

Medi-Dose Ad, p. 453, Apr. 1979, *American Journal of Hospital Pharmacy.*

Philips-Roxane Laboratories Ad, p. 454, Apr. 1979, *American Journal of Hospital Pharmacy.*

*American Journal of Hospital Pharmacy,* pp. 162-163, Feb. 1980.

Philips-Roxane Ad, pp. 632-633, May 1980, *American Journal of Hospital Pharmacy.*

*Primary Examiner*—George T. Hall

*Attorney, Agent, or Firm*—Richards, Harris, Medlock & Andrews

[57] ABSTRACT

A sealing cover (10) is disclosed for resealing a side injection port (14) on an IV solution container (12). Sealing cover (10) has a first end portion (28), a center portion (30) and a second end portion (32) which define a cover region (24). One side of the cover region (24) has an adhesive material (44) so that the cover can be adhesively secured to the port (14). A nonadhesive region (48) is positioned over the injectable membrane (20) of the port. The first and second end portions (28, 32) are folded relative to the center portion (30) and wrapped about the cylindrical portion (16) of the port (14) to enhance the adhesive attachment. Protrusions (36) on the center portion (30) can also be folded against the cylindrical portion for adhesive attachment. A pull tab region (26) extends from one of the end portions to permit removal of the cover. Separation slits (34) are provided which extend along both sides of the nonadhesive region (48) over the injectable membrane so that the membrane will be exposed as the cover is removed but parts of the center portion and end portions will remain as a telltale to indicate that the seal has been removed.

64 Claims, 13 Drawing Figures

FIG. 1
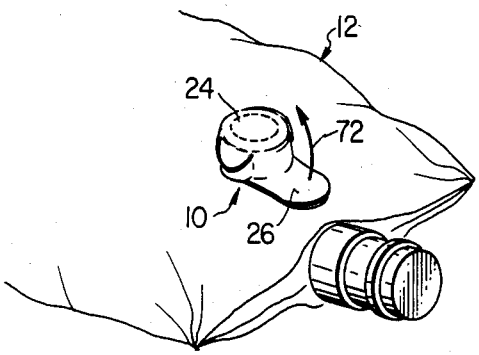
FIG. 2
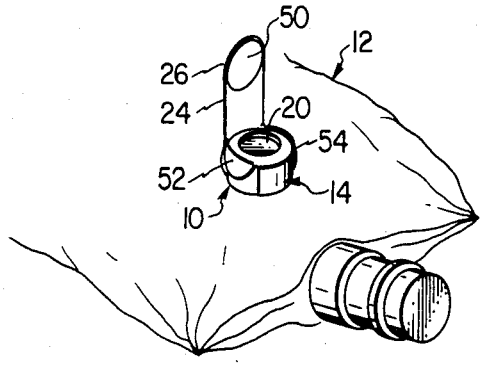
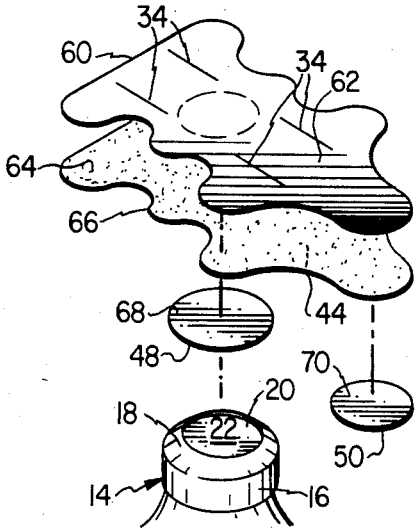
FIG. 3
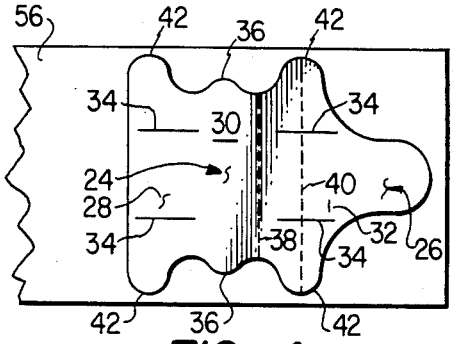
FIG. 4
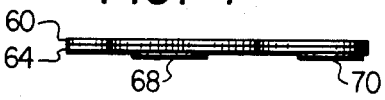
FIG. 5
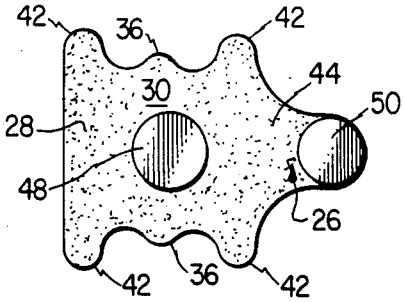
FIG. 6

FIG. 7
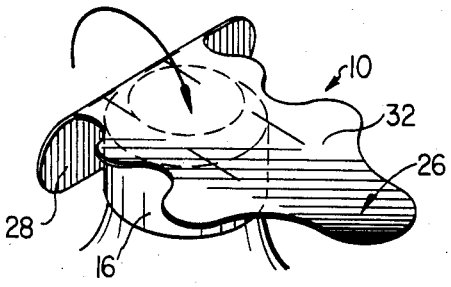
FIG. 8
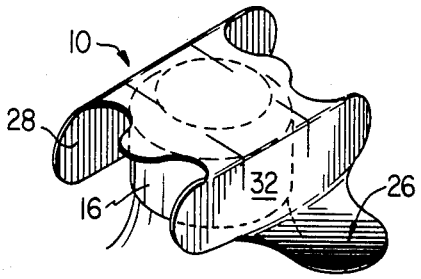
FIG. 9
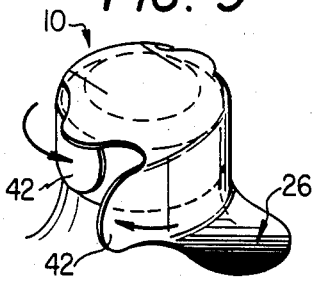
FIG. 10
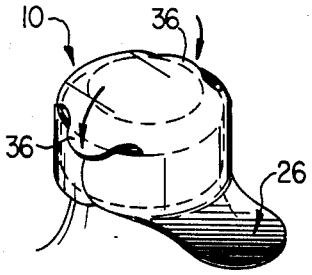
FIG. 11
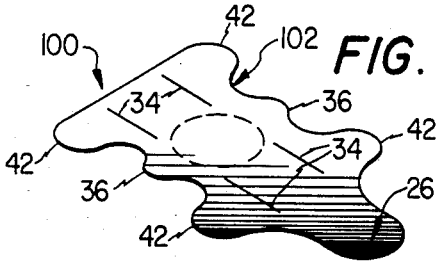
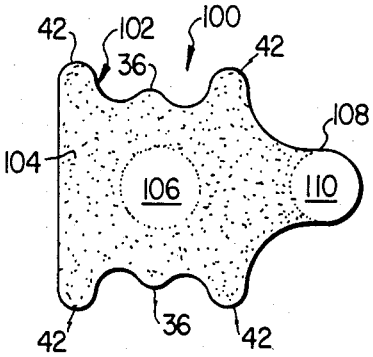
FIG. 12
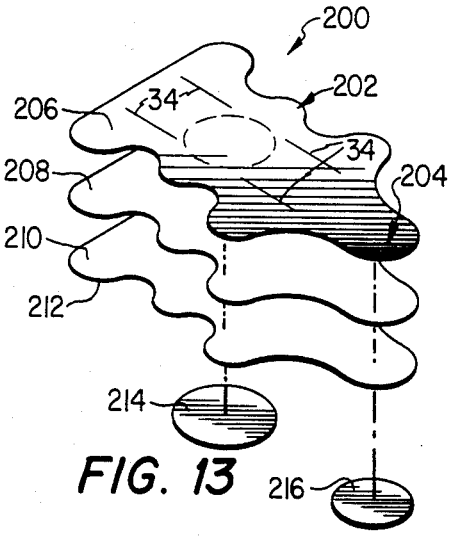
FIG. 13

FLEXIBLE STERILE CLOSURE SYSTEM FOR A CONTAINER WITH A SIDE INJECTION PORT

TECHNICAL FIELD

This invention relates to an article and method for resealing an intravenous pharmaceutical container having a side injection port, and more particularly to a thin film seal for resealing the pharmaceutical container.

BACKGROUND OF THE INVENTION

Intravenous (IV) additives and injectable unit dose programs are administered in many hospitals as one method for introducing medications into a patient for a prescribed treatment. In prescribing an IV additive or an intramuscular medication unit dose treatment program, the doctor may order any one of a number of drugs or vitamins to be injected intramuscularly or added to the solution in a sterilized IV container and administered intravenously to a patient. The quantity of the drug or vitamin is also prescribed by the doctor to adjust the dosage of medication to the intravenous solution to the needs of each patient. In addition to the method of adding drugs and vitamins to an IV container for an IV additive program, some IV additive programs may be instituted by combining an IV additive solution in a "piggyback" arrangement of containers for certain specialized treatments requiring a combination of drugs.

In a hospital's IV additive program, the prescribed medication is added to an IV bottle or plastic IV bag by inserting a needle into the "target area" of a membrane closing the top of an IV solution bottle or a membrane covering the inlet port of a plastic IV bag. The IV solution bottle has a sterile seal covering the membrane area prior to the time of adding medication to the bottle. The IV bottle must be resealed under sterilized conditions to prevent airborne bacteria, such as *Pseudomonas Aeruginosa,* from accumulating on the exposed surface of the IV bottle covering. In addition to maintaining a sterile surface of a bottle, the resealing of the bottle alerts the hospital staff that the original contents have been altered by the pharmacy and have not been altered since then. A hospital's nursing staff is trained not to adminster the IV solution unless one of the members of the staff mixed the contents, or there is some means to alert the nursing staff that the contents have not been altered since they were prepared in the pharmacy department. In the case of the plastic IV bag, the sealing cover protects the "plug" in the inlet port from becoming dislodged during storage or transport, and the cover also alerts the pharmacy that the contents have not been altered so that the container and its contents may be reissued to another patient.

The prior practice has been to utilize a plastic cap for resealing the IV containers. The plastic cap for the bottle container snaps over the top of the metal rim surrounding the rubber membrane to completely cover and seal the top of the solution bottle. For the IV bags, the prior practice uses a plastic cap or a heat shrink plastic wrap to reseal the plastic IV bag's inlet port. The seal for the IV bag is seldom removed, since a separate outlet is used for administering the drugs to the patient. However, in those instances when it is necessary to remove the inlet port seal, the plastic cap sometimes must be fractured. In removing the plastic cap, the rubber plug in the inlet port may be dislodged, breaking the sterility barrier and requiring a hospital to discard the IV bag.

In an effort to hold down hospital costs in reducing the allocation for expensive inventory space, the prior practice of most hospitals has attempted to maintain only one size plastic cap in inventory for IV bottles and another one for IV bags. Since the IV solution and the piggyback containers are manufactured by different manufacturers, the tops are not of uniform diameter. The plastic caps do not provide the necessary sterilized seal in resealing the IV containers if there is not a tight mechanical closure over the container top. As a result of the tight fit required between the plastic cap and a metal seal of a bottle, the nursing staff often faces a problem in attempting to separate the plastic cap from the metal rim. The nursing staff often must resort to using expensive surgical instruments or scissors, which can be damaged, to help them in prying off the plastic sealing cap. The difficulty of removing the plastic caps from IV containers has resulted in some hospitals issuing pliers to the nursing staff to remove the caps. Removal of plastic caps or resealing intravenous containers has resulted in the inefficient use of the services of skilled personnel, such as registered nurses, in attempting to remove container closures. More importantly, many of the prior art closures and methods for sealing IV solution bottles do not allow a nurse inspecting a container without a sealing cover to know where it was removed, if another drug was added, if it was previously resealed, or how the drugs were added. In such a situation, rather than risk exposing the patient to a serious infection from harmful bacteria which may have accumulated on top of such a container, or the risk from any tampering with the container, the nurse must often reject the container, which results in wasting the medication as well as a delay in administering the medication to a patient while additional medication is reordered from the pharmacy department.

The present hospital practice does not normally include removing the plastic cap or heat shrink plastic wrap applied to the inlet port of an IV bag. Unlike the IV bottle, a separate outlet port is provided for connecting the container intravenously to the patient. The reentry into the inlet port that has become contaminated pushes contamination back into the bag. However, the difficulties encountered in reentering the inlet port with prior resealing techniques often result in the loss of the entire container and its contents on those occasions when it is either desirable to change the dosage of the medication or the unit is not used and is returned to the pharmacy department. As the medication in the container may be quite expensive, this represents a substantial loss to the hospitals.

On May 12, 1981, U.S. Pat. No. 4,266,687 issued to the same assignee as the present invention. This patent is for a sealing cover and method for resealing an intravenous container. The invention covered by that patent is an improvement over the prior practice of resealing IV bottles with molded plastic caps.

On June 28, 1983, U.S. Pat. No. 4,390,104 issued to the same assignee as the present invention and is for a flexible plastic sterile closure system for containers. The invention covered by that patent provides further improvements, including the use of a sealing cover with a layer of material having "t-shaped" slits to promote separation of the cover to leave telltale strips of material on the port to indicate use.

On Jan. 3, 1984, U.S. Pat. No. 4,423,819 issued to the same assignee as the present invention and is for a flexible sterile closure system for containers. The inventions covered by that patent are additional improvements, including the improvement in the flexibility of the cover seal to better form and adhere the cover seal to a container.

While the sealing covers and methods for resealing an intravenous container in these patents have proved extremely effective in use, specific intravenous container designs require the use of especially adapted sealing covers. One example of a particularly difficult intravenous container to reseal is the intravenous bag which incorporates a side injection port. The side injection port includes a cylindrical portion which extends outward from the side of the intravenous bag. An injectable membrane covers the exposed end of the cylindrical portion and has an outer surface of convex shape. A needle can be inserted through the injectable membrane in order to fill or empty the bag. A need exists for a flexible cover having the advantages of the covers in the aforementioned U.S. patents, but that is specifically adapted for use with an intravenous bag having a side injection port.

DISCLOSURE OF THE INVENTION

In accordance with one aspect of the present invention, a flexible sealing cover is provided for resealing the side injection port of a pharmaceutical container. The injection port has a cylindrical portion extending from the container and an injectable surface at the exposed end of the cylindrical portion. The sealing cover includes a cover region having a center portion and first and second end portions extending from opposite sides of the center portion. The cover region has a nonadhesive area on a first side thereof for covering the injectable membrane and the remainder of the first side on the cover region has an adhesive area for securing the cover region to the port.

The center portion is adhesively secured to the port about the periphery of the injectable membrane and has protrusions extending from the edges thereof between the end portions for folding against the cylindrical portion of the port for adhesive attachment thereto. Each of the end portions is foldable against the cylindrical portion of the port for adhesive attachment thereto. Each of the end portions has protrusions extending from opposite edges thereof for extending about a portion of the cylindrical portion of the port to enhance the attachment.

A pull tab region is provided which extends from one of the end portions. Means are provided for tearing the cover along at least one tear line upon removal. After removal, a telltale mark remains to show that the seal has been broken.

In accordance with another aspect of the present invention, the dimension along the fold line between the end portions and the central portion is relatively narrow compared to the dimensions along the end portion parallel the fold line so that the end portion is wrapped about a substantial portion of the periphery of the cylindrical portion of the port.

In accordance with yet another aspect of the present invention, the sealing cover is preferably formed of multiple layers. A first layer of plastic film forms an upper surface that is substantially impermeable to moisture and bacteria. A second layer of a flexible film is made from a material capable of plastic deformation under stress. Means for bonding are provided to bond the first and second layers together. Finally, the area of adhesive material is bonded to the surface of the second layer.

In accordance with still another aspect of the present invention, a method is provided for resealing the side injection port of a pharmaceutical container. A port has a cylindrical portion extending from the pharmaceutical container and an injectable membrane at the exposed end of the cylindrical portion. The method includes the step of removing a flexible sealing cover adhesively affixed to a carrier liner, the sealing cover having a cover region and a pull tab region at one end of the cover region. The method further includes the step of positioning the adhesive side of the cover region on the port so that a nonadhesive area of the adhesive side covers the injectable membrane and a central portion of the cover region is adhesively secured to the port about the injectable membrane. First and second end portions extend from opposite sides of the central portion and are folded against the cylindrical portion of the port. The first and second end portions are then wrapped about a portion of the periphery of the cylindrical port to adhesively secure the end portions to the port. First and second protrusions extending from opposite sides of the central portion between the end portions and are folded against the cylindrical portion and adhesively secured to the cylindrical portion.

BRIEF DESCRIPTION OF THE DRAWINGS

For a more complete understanding of the present invention and the advantages and features thereof, reference is now made to the accompanying Detailed Description taken in conjunction with the following figures in which:

FIG. 1 is a perspective view of an IV solution container having a side injection port resealed with a flexible sealing cover of the present invention;

FIG. 2 is a perspective view of the IV solution container of FIG. 1, illustrating the removal of the cover and the strips of the sealing cover which adhere to the two sides of the port upon removal of the sealing cover;

FIG. 3 is an exploded view of the laminated structure of the sealing cover of the present invention positioned above the injection port;

FIG. 4 is a top view of the sealing cover;

FIG. 5 is a side view of the sealing cover of the present invention;

FIG. 6 is a bottom view of the sealing cover of the present invention;

FIG. 7 is a perspective view of the IV solution container and the sealing cover with the first end portion of the sealing cover folded against the port;

FIG. 8 is a perspective view of the IV solution container and the sealing cover illustrating the folding of the second end portion against the port;

FIG. 9 is a perspective view of the IV solution container and sealing cover illustrating the protrusions from the end portions wrapped about the port; and FIG. 10 is a perspective view of the IV solution container and the sealing cover with the sealing cover secured in place;

FIG. 11 is a perspective view of a sealing cover forming a second embodiment of the present invention having a single layer of foil film;

FIG. 12 is a bottom view of the sealing cover of FIG. 11; and

FIG. 13 is an exploded view of a third embodiment having three layers.

DETAILED DESCRIPTION

With reference now to the figures, a sealing cover 10 is shown for use with an IV solution or other pharmaceutical container 12. The container 12 has a side injection port 14 which includes a cylindrical portion 16 which extends outwardly from the side of the container 12. The cylindrical portion 16 ends in an annular rim 18 which surrounds injectable membrane 20 which defines a convex injectable surface 22. In general, the cylindrical portion 16 will be metal and the injectable membrane 20 will be a rubber material.

The sealing cover 10 is shown secured in place and conforming to the port of the container 12 in FIG. 1. The sealing cover 10 includes a cover region 24 and a pull tab region 26. The cover region 24 is itself divided into three portions, a first end portion 28, a center portion 30 and a second end portion 32. The pull tab region 26 forms an extension of the second end portion 32.

The center portion 30 covers the injectable membrane 20 and is adhesively secured about the annular rim 18. The first and second end portions 28 and 32 are folded against the side of the cylindrical portion 16 and are adhesively secured thereto. The pull tab region 26 can be grasped to pull the sealing cover 10 off the port 14 with individual linear separation slits 34 guiding the tear so that remnants of the cover 10 remain as seen in FIG. 2 to show that the container has been opened.

Protrusions 36 extend from opposite edges of the center portion 30 between the end portions 28 and 32 as best seen in FIGS. 4 and 6. These protrusions 36 can be folded to lie against the side of the cylindrical portion and be adhesively secured thereto to promote a more secure attachment of the cover 10 to the port 14. However, if desired, the protrusions 36 can be deleted.

The width 38 of the sealing cover 10 between the center portion and end portions 28 and 32 is relatively narrow to permit the end portions to be folded against the side of the cylindrical portion without significant deformation of either the center portion 30 or end portions 28 and 32. The width 40 of each of the end portions 28 and 32 is substantially greater than the width 38 in view of the protrusions 42 which extend from the opposite edges of the end portions. As can be seen in FIGS. 9 and 10, the end portions can be wrapped about a substantial portion of the cylindrical portion with use of the protrusions 42. The width 40, when curved to correspond with the curvature of the cylindrical portion 16, will extend about approximately half the circumference of the cylindrical portion 16. If desired, the width 40 can be increased so that the protrusions 42 on the end portions overlap each other as shown in FIG. 10.

With reference to FIG. 6, the bottom of the sealing cover can be seen to include a layer of adhesive material 44 which forms a first side of the sealing cover 10 with the exception of a nonadhesive region 48 for covering the injectable membrane 20 and a nonadhesive region 50 on the pull tab region 26.

FIG. 2 illustrates the IV solution container 12 and sealing cover 10 of FIG. 1 during the removal of the cover 10. The nonadhesive region 48 and layer of adhesive material 44 are exposed as the cover 10 is removed. The telltale strips 52 and 54 remain in place on the cylindrical portion 16 and indicate that the sterilized seal has been broken. Because the separation slits 34 direct the tear, it is likely that remnants of both the first and second end portions 28 and 32 will also remain on the cylindrical portion 16, including the protrusions 42. These telltale pieces further reinforce the indication of breach of the sterilized seal. Upon removal of the sealing cover 10, the IV solution container 12 is ready for a member of the nursing staff of a hospital to insert a needle or an IV spike in an IV administrative set through the injectable membrane 20 to begin the administration of an IV additive solution in a container 12 to the patient.

FIG. 4 is a top view of a sealing cover 10 packaged upon a strip of carrier liner 56. The liner 56 can carry a number of covers 10. The liner 56 has been coated with controlled release chemicals to allow the adhesive material 44 to adhere to it for packaging purposes, yet allow the adhesive material 44 to be separated from the liner 56 without causing the cover 10 to separate. The sealing covers 10 may be packed upon a continuous strip of carrier liner 56 and rolled into a spiral ring for use in a flat cardboard container for dispensing individual sterilized sealing covers 10. The improved sealing cover 10 of the present invention may be packed in bulk on a carrier liner 56, requiring approximately only 10% of the storage space previously required for the molded plastic resealing caps of the prior art.

FIGS. 3 and 5 illustrate a laminated structure which forms one embodiment of the sealing cover 10. An upper layer 60 of the cover 10 may be formed from a material generally impermeable to bacteria and moisture, e.g., a thermosetting plastic, such as polypropylene, polystyrene, polyester, polyethylene or other plastic. The plastic film has a desired thickness of between 0.00025 to 0.003 inches. In one embodiment, a 0.00092 inch thick polyester film has proven satisfactory. The upper layer 60 may be imprinted with a message 62 which could provide information concerning the IV additive solution, as well as to promote the visibility of the telltale strips 52 and 54 left on the side injection port 14 upon separation of the cover 10. The printing on layer 60 may be on the upper surface with an alcohol resistant ink or reverse printed on the opposite side of layer 60. A layer of adhesive material 64 is applied to one surface of the upper layer 60 which is to be mated with a second layer of foil film 66. The foil film layer 66 may be formed from metallic foil, such as aluminum foil, having a desired thickness of between 0.00025 and 0.003 inches. The commercial acceptable grades of metallic foil which may be used are the following:

(a) dead soft foil,
(b) half hard foil
(c) full hard foil

The tempering of the foil determines the grading of these various types of foil film. The layer 60 and 66 may also be bonded together as an extruded laminate wherein the foil film layer 66 has a desired thickness in the range of 0.00025 to 0.003 inches. In one cover 10 of this embodiment, an aluminum foil film having a thickness of 0.00035 inches has proven satisfactory. The second layer 66 of foil film provides the plastically deformable characteristic to the cover without losing the flexibility to conform to the side injection port 14. The second layer 66 even allows the cover 10 to retain its shape on metal cylindrical portion 16 and annular rim 18 that has been swabbed with alcohol. The flexibility provided in the upper layer 60 of plastic film and second layer of foil film 66 allows for a standard size sealing cover 10 to be provided with an enlarged cover region 24 which still remains flexible enough to conform to the shape of large and small side injection ports 14. The foil film has a characteristic of plastic deformation to retain the seal 10 in its deformed shape about the port 14 as shown in FIG. 1. Indicia relating to the contents of the container 12 to which the seal 10 is applied may also include printing on the foil film layer 66. Indicia may also be applied by color coding the seal 10 by the use of a color coded foil or plastic film, or by the addition of a dye material to the adhesive layer 64. Of course, where the indicia is applied to the second layer 66 or adhesive layer 64, the upper layer 60 is transparent.

In another embodiment, the sealing cover 10 may be constructed with the upper layer 60 being made from foil film and joined or bonded to the second layer 66 being made from a plastic film, e.g., an acrylic plastic, polypropylene or polystyrene. The sealing cover 10 of this embodiment has the same desirable characteristics as noted above.

In either of the above embodiments (whether the plastically deformable material is the first or second layer), the layer of adhesive material 44 is applied to the surface of the second layer 66 to engage the side injection port 14. In order to prevent the adhesive material 44 from contacting the injectable membrane 20 on the side injection port 14, a disk 68 is bonded to the adhesive layer 44 to form nonadhesive area 48. The disk 68 may be coated with a release material, e.g., silicone, to promote its separation from the carrier liner 56. Similarly, a disk 70 is bonded to the adhesive material 44 in the pull tab region 26 to cover the adhesive material 44 and form nonadhesive area 50 and insure that the pull tab region 26 can be readily grasped by a nurse. The disks 68 and 70 may be made from a polystyrene or other material, and the disks 68 and 70 may be made from a material, e.g, polystyrene, to enhance telltale puncture marks in the plastically deformable material of layer 66 to indicate if the contents of the IV container have been altered since it left the pharmacy department.

Another means for forming a nonadhesive region 48 or 50 upon the adhesive layer 44 is a chemical sealant, such as an ink solution or lacquer material, applied to the central region of the adhesive material 44 to seal the adhesive material 44 from contacting the injectable membrane 20. In addition, the adhesive layer material 44 may be applied with patterned printing of the adhesive to leave the desired area free of adhesive material.

FIG. 4 illustrates a top view of the sealing cover 10 which shows the separation slits 34 formed in the upper plastic layer 60 to promote the separation of materials upon removal of the cover 10 from the side injection port 14 to leave the telltale strips 52 and 54. In the preferred embodiment, four separation slits 34 are used as shown in FIG. 4 with two extending along the tear line on either side of the injectable membrane 20. As can be seen, the separation slits 34 extend across a substantial portion of the length of the end portions 28 and 32 and extend into the center portion 30. If desired, the two slits 34 can be extended toward the center of the cover to create a single longer slit. However, none of the separation slits 34 extend to an external edge of any portion of the cover region 24. This reduces the likelihood of accidental tearing of the sealing cover 10 and also reduces the likelihood of tearing the sealing cover 10 when removing it from the carrier liner 56.

In use, the sealing cover 10 is manufactured under clean conditions and attached to a chemically treated carrier liner 56 to retain the sterility of the cover 10 during storage prior to its use. The strip of carrier liner 56 may be rolled and placed in a dispensing carton (not shown) and the cartons may be packaged in plastic bags. The bags containing the package seals 10 are sterilized by using ethylene oxide gas to meet the current sterility standards of the U.S. Pharmacopoeia (U.S.P. No. 19). Of course, the strip of carrier liner 56 with attached sealing covers 10 may be packaged in any suitable configuration design for ease in dispensing the sealing covers 10, and it may be sterilized by any means meeting the current or future standards of the U.S. Pharmacopoeia.

In a normal hospital additive IV program, the original sealing cover for the IV solution container 12 installed by the manufacturer is removed by a nurse or other hospital personnel under procedures prescribed for maintaining sterile conditions. The prescribed medication is then added to the IV solution in container 12 under a sterile hood or similar hospital condition for maintaining a sterile work environment. The medication may be added to a full bottle or to a piggyback bottle, or a diluent may be added to a bottle to reconstitute a powdered drug.

Medication is introduced into the container 12 by puncturing the injectable membrane 20 with a transfer system, such as a syringe containing a controlled quantity of the prescribed medication, an IV transfer needle, an IV additive vial, or another medication transfer device. Upon release of the medication into solution, the syringe is withdrawn. A sterile sealing cover 10 is then withdrawn from its dispenser and removed from the special carrier liner 56 by means of the pull tab 26. The polystyrene disk 68 or other area of the cover 10 aligned with the membrane 20 remains in a sterile condition until removal from the carrier liner 56. A disk 68 is positioned over the membrane 20, and the center portion 30 is pressed against the annular rim 18 so that the adhesive material 44 on the center portion 30 adheres to the annular rim 18. This can be done by a slight pressure from the palm of the hand on the upper surface of the sealing cover 10.

The first end portion 28 can then be folded against the side of the cylindrical portion 16 as shown in FIG. 7. The line of contact between the adhesive 44 on the first end portion 28 and the cylindrical portion 16 will usually be enough to maintain the fold while the second end portion 32 is similarly folded against the cylindrical portion as shown in FIG. 8. The first and second end portions 28 and 32, including protrusions 42, can then be wrapped around the cylindrical portion 16 as shown in FIG. 9 so that the end portions are adhesively secured to the cylindrical portion along their entire width 40. Finally, the protrusions 36 can be folded and pressed against the side of a cylindrical portion 16 as seen in FIG. 10 to provide further attachment of the sealing cover 10 to the port 14.

The pull tab region 26 extends from the outer edge of the second end portion 32 which is located near the part of the cylindrical portion 16 nearest the container 12 when folded against portion 16 as seen in FIGS. 8, 9 and 10. Therefore, the pull tab region 26 extends close to the surface of the container 12 and resists inadvertent opening of the cover 10.

The top or bottom of the sealing cover 10 may include an imprinted code for identification purposes, such identification as the identity of the drug added to the IV solution, or any other information which may be desired by the user. In addition, the foil film, either first layer 60, adhesive layer 64 or second layer 66, may be color coded to indicate information concerning the contents or the department of the hospital which is to handle and administer the container 12.

The sterile seal of the reseal IV container 12 is not broken until the nursing staff is ready to administer the IV solution to the patient. The sealing cover 10 may be removed by hand, without using any instruments, such as pliers or scissors, which are often required for the prior art plastic resealing caps. The pull tab region 26 of the sealing cover 10 is grasped by the nurse and pulled upwards in the direction generally indicated by the arrow 72 of FIG. 1 in order to properly remove the cover 10 from the port 14 and expose the rubber membrane 20. The separation slits 34 facilitate the beginning of the separation of the cover 10 and leave the two telltale strips 52 and 54 and portions of the protrusions 36 and 42 still attached to the cylindrical portion 16 of the port 14. The telltale material left on the cylindrical portion 16 alerts the hospital staff that the sterile seal has been removed. A second check that the integrity of the IV additive solution has not been tampered with is to check the polystyrene disk 68 for any puncture marks to indicate a drug may have been added after the container left the pharmacy department. Once the sealing cover 10 has been removed, a nurse may insert an IV spike of an IV administration set through the rubber membrane 20 and complete the connection through the plastic tubing to an intravenous catheter inserted into the vein of the patient.

FIGS. 11 and 12 illustrate another embodiment of the present invention, a sealing cover 100 made from a single layer of foil film 102. A number of elements in sealing cover 100 are identical to those in sealing cover 10 and are identified by the identical reference numerals. The single layer of foil film 102 may be formed from a sheet of foil type material, such as aluminum foil tempered as dead soft, half hard or full hard foil. One possible choice of material is a dead soft aluminum foil with a thickness of 0.00035 to 0.003 inches. The foil film 102 may include indicia as described above for sealing cover 10 to designate the type of additive in the IV solution, or special handling requirements, e.g., whether or not the IV solution container needs to be refrigerated.

FIG. 12 is a bottom view of the sealing cover 100 illustrated in FIG. 11. The bottom surface of the sealing cover 100 includes an adhesive layer 104 for providing sealing engagement with the side injection port 14. An adhesive free area 106 of the bottom of the sealing cover 100 is maintained for the covering the membrane 20 of the port 14. The adhesive free area 106 may be formed on the bottom surface of sealing cover 100 by covering the surface with a disk, such as plastic disk 68 illustrated in FIGS. 3 and 6 and described hereinabove. Of course, the adhesive free area 106 may also be formed by other means described above for sealing cover 10, as by applying a layer of chemical sealant, such as an ink or lacquer material, or patterning the adhesive layer 104 to keep it from contacting the membrane 20 covering the port 14. The pull tab region 108 of the sealing cover 100 may also include a plastic disk 110 for forming a more rigid pull tab and for sealing off the adhesive material on the pull tab region of the sealing cover 100. As noted for the adhesive free region 106, the bottom surface of the pull tab region 108 also may be coated with a chemical sealant or patterned printing of the adhesive to keep the adhesive layer 104 from contact with the pull tab region 108.

FIG. 13 illustrates yet another embodiment of the sealing cover of the present invention, a sealing cover 200. The cover 200 is used with an IV solution container 12 to cover the port 14. The sealing cover 200 includes a cover region 202 and a pull tab region 204.

The sealing cover 200 includes three layers of material: a first layer 206 of plastic film, a second layer 208 of plastically deformable film, and a third layer 210 of plastic film. The multiple layers 206, 208 and 210 may be joined together with intervening layers of adhesive material or bonded by extruding the plastic layers 206 and 220 onto the foil film layer 208. The layers 206, 208 and 210 are impermeable to moisture and bacteria to retain the sterility of the resealed container 12. The first and third layers 206 and 210 may be formed from a film of thermosetting plastic, such as a polypropylene, polystyrene, polyester or polyethylene, with the film having a thickness of between 0.00025 and 0.003 inches. The second layer may be formed from aluminum foil film also having a thickness of between 0.00025 and 0.003 inches and from dead soft, half hard or full hard foils.

The sealing cover 200 may include printing as described above for sealing cover 10 as indicia relating to the container to which the cover 200 is applied. The sealing cover 200, as well as seals 10 and 100, may also have a plain surface without any visible printing to prevent tampering with the contents of the container from a needle puncturing the seal cover 200.

The lamination of materials of sealing cover 200 provides a flexible seal for conforming to the top of the container 12, yet a seal with enough stiffness to inhibit curling back upon itself when the cover is removed from a strip of carrier liner. The separation slits 34 formed in the cover 200 promote the separation of a cover 200 along parallel tear lines coincident with the length of the slits. The cover 200 is removed from the container 12 by raising the pull tab section 204. Again, the separation of the cover 200 upon removal causes telltale strips of material to be left in engagement with the cylindrical portion 16, such as telltale strips 52 and 54 seen in FIG. 2.

A layer of adhesive material 212 is applied to the surface of the third layer 210 which adheres to a carrier liner and packaging and engages the port 14 in sealing the container 12. A disk 214 provides a means for separating the adhesive material 212 from the membrane 20 on the container 12. A second disk 216 provides an adhesive free region in the pull tab region 204 to allow the cover 200 to be gripped for removal from the carrier liner, placement on the container 12 and removal from the container 12. The disks 214 and 216 may be made from a polystyrene material. Of course, the adhesive free regions may be formed by other means, such as those described above by applying an adhesive sealant to the adhesive material 212 or patterning the adhesive material 212 to provide the desired adhesive free regions.

Although the preferred embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention. In addition to its use as a sterile reclosure seal, the sealing covers 10, 100 and 200 may also be used on container tops for security seals. Whether or not these seal covers serve to maintain the sterility of the container, it may also serve as a means for indicating that the container seal has been broken by use of the telltale strips when the cover is removed.

I claim:

1. A flexible sealing cover for resealing the side injection port of a pharmaceutical container, the port having a cylindrical portion extending from the container and an injectable membrane at the exposed end of the cylindrical portion, the sealing cover including:

a cover region having a center portion and first and second end portions extending from opposite sides of the center portion;

a pull tab region extending from one of the end portions of the cover region;

said cover region having a nonadhesive area on a first side thereof for covering the injectable membrane with the remainder of the first side having adhesive for securing the cover region to the port;

said center portion of the cover region being adhesively secured to the port about the periphery of the injectable membrane, said center portion having protrusions extending from the edges thereof between the end portions for folding against the cylindrical portion of the port for adhesive attachment thereto;

each of said end portions for folding against the cylindrical portion of the port for adhesive attachment thereto and having protrusions extending on opposite sides of the end portions for wrapping about a portion of the cylindrical portion to enhance the attachment; and means for tearing the cover along at least one tear line upon its removal with said pull tab region from the port to leave a telltale mark that the seal has been broken.

2. The flexible sealing cover of claim 1 wherein the protrusions on the end portions are sized so that when an end portion is wrapped about the cylindrical portion of the port, the end portion extends approximately halfway about the periphery of the cylindrical portion.

3. The flexible sealing cover of claim 1 wherein the width of the sealing cover at the transition between the center portion and the end portions is relatively narrow compared to the width of the end portions.

4. The flexible sealing cover of claim 1 wherein the cover region further comprises:

a first layer of plastic film forming an upper surface of the cover region, said first layer being substantially impermeable to moisture and bacteria;

a second layer of a flexible film forming a next layer of the cover region, said second film layer being made from a material capable of plastic deformation under stress;

means for bonding said first layer to said second layer; and said adhesive being bonded to the surface of said second layer.

5. The flexible sealing cover of claim 1 wherein said nonadhesive area of said cover portion is formed by a disk attached to said adhesive.

6. The flexible sealing cover of claim 1 wherein said means for tearing the cover comprises:

at least one slit formed in said sealing cover to promote tearing of the cover along the tear line for forming telltale strips of material to indicate the removal of the cover.

7. The flexible sealing cover of claim 6 wherein said slit is linear and generally parallel to the line of tear.

8. The flexible sealing cover of claim 1 wherein said means for tearing the cover is formed by a plurality of slits formed in the cover along the tear line.

9. The flexible sealing cover of claim 1 wherein said means for forming a nonadhesive area is formed by the application of an adhesive sealant applied to the surface of said adhesive material.

10. The flexible sealing cover of claim 9 wherein said sealant is an ink solution.

11. The flexible sealing cover of claim 9 wherein said sealant is lacquer material.

12. The flexible sealing cover of claim 4, wherein said first layer is a polyester material.

13. The flexible sealing cover of claim 4 wherein said first layer is a polystyrene material.

14. The flexible sealing cover of claim 4 wherein said first layer is of polypropylene material.

15. The flexible sealing cover of claim 1 and further comprising:

a strip of silicone coated carrier paper for packaging the cover, said adhesive material being loosely bonded to said carrier material to allow removal of the cover with said pull tab region without causing the separation of the cover.

16. The flexible sealing cover of claim 1 and further comprising:

means for printing a visually recognizable mark on the cover, whereby said mark provides information about the container.

17. The flexible sealing cover of claim 4 wherein said second layer is co-extensive with said first layer throughout the cover region, whereby any needle marks through the cover region are visually identifiable.

18. The flexible sealing cover of claim 4, wherein said first layer is a polyester film between 0.00025 and 0.001 inches in thickness and said second layer is an aluminum foil film between 0.00025 and 0.00035 inches of thickness.

19. The flexible sealing cover of claim 4, wherein said means for bonding is a layer of adhesive material joining said first layer to said second layer.

20. The flexible sealing cover of claim 19 wherein said first layer of film is transparent and said adhesive material bonding said first and second layers includes a dye material for providing some color coded indicia relating to the pharmaceutical container to which the cover is supplied.

21. The flexible sealing cover of claim 4, wherein said second layer of film is a metallic foil.

22. The flexible sealing cover of claim 21, wherein said metallic foil is a dead soft foil.

23. The flexible sealing cover of claim 21, wherein said metallic foil is a half hard foil.

24. The flexible sealing cover of claim 21, wherein said metallic foil is a full hard foil.

25. The flexible sealing cover of claim 4, wherein said first layer and said second layer are each between 0.00025 and 0.003 inches in thickness.

26. The flexible sealing cover of claim 4, wherein said means for bonding comprises extruding said first layer of plastic material onto said second layer of plastic deformable film.

27. The flexible sealing cover of claim 1, further comprising:

means for forming an adhesive free area on said pull tab region, whereby the cover can be handled by said pull tab region.

28. The flexible sealing cover of claim 1, wherein said nonadhesive area is created by applying a predetermined pattern of adhesive to said cover region.

29. The flexible sealing cover of claim 4, wherein said first layer is transparent and further comprising:

printing on the surface of said first layer opposed to said second layer, whereby the printing provides some indicia relating to the pharmaceutical container to which the cover is applied.

30. The flexible sealing cover of claim 4, wherein said first layer is transparent and further comprising:

printing on the surface of said second layer opposed to said first layer, whereby the printing provides some indicia relating to the pharmaceutical container to which the cover is applied.

31. A flexible multi-layered sealing cover for resealing a side injection port of a pharmaceutical container, the port having a cylindrical portion extending from the container and an injectable membrane at the exposed end of the cylindrical portion, said sealing cover comprising:

a cover region having a center portion and first and second end portions extending from opposite edges of the center portion, the cover region including:

a first layer of a flexible film forming an upper surface of the cover region, said first layer being substantially impermeable to moisture and bacteria being made from a material which deforms plastically under stress;

a second layer of flexible plastic material forming a next layer of the cover region;

means for bonding said first layer to said second layer;

means for forming a layer of adhesive material on the surface of said second layer;

means for forming an adhesive free region within the layer of adhesive material;

a pull tab region extending from one of the end portions;

the cover region being positionable with the adhesive free region proximate the injectable membrane of the side injection port, the remainder of the cover portion being adhesively secured to the port about the injectable membrane, said center portion further having protrusions extending outwardly from the edges thereof between the first and second end portions for folding against the cylindrical portion of the port for adhesive attachment thereto;

each of said first and second end portions for folding relative to the center portion against the cylindrical portion of the port, each of the first and second end portions being adapted to wrap around part of the periphery of the cylindrical portion of the port for adhesive attachment thereto; and means for tearing the cover along at least one tear line upon removal of the cover from the container with a pull tab, whereby application of the cover to the container results in plastic deformation of said first layer.

32. The flexible sealing cover of claim 31, wherein the cover region is notched inwardly between the cover portion and the end portions to define a relatively narrow width at the intersection of the cover portion and end portions so that the folding of the end portions against the cylindrical portion of the port does not excessively deform the cover portion.

33. The flexible sealing cover of claim 31, wherein the width of the end portions along a dimension generally parallel to the folds between the end portions and center portion is sufficient so that each end portion wraps around about one-half of the periphery of the cylindrical portion of the port.

34. The flexible sealing cover of claim 31, wherein said first layer of layers of metal foil between 0.00025 and 0.001 inches in thickness and said second layer is a polyester film between 0.00025 and 0.00035 inches in thickness.

35. The flexible sealing cover of claim 31, wherein said first and second layer are each between 0.00025 and 0.003 inches in thickness.

36. The flexible sealing cover of claim 31, wherein said second layer is co-extensive with said first layer over the area of the cover region.

37. The flexible sealing cover of claim 31, wherein said means for tearing the cover along at least one tear line includes a plurality of slits along the line of tear.

38. The flexible sealing cover of claim 31, wherein said means for forming an adhesive free region is formed by the application of adhesive sealant applied to the surface of said adhesive material.

39. The flexible sealing cover of claim 31, wherein said means for bonding is a layer of adhesive material joining said first layer to said second layer.

40. The flexible sealing cover of claim 31, wherein said first layer is a metallic foil.

41. The flexible sealing cover of claim 40, wherein said metallic foil is a half hard foil.

42. The flexible sealing cover of claim 40, wherein said metallic foil is a full hard foil.

43. The flexible sealing cover of claim 40, wherein said metallic foil extends across the cover region, whereby any needle puncture through the cover region leaves a visually recognizable opening to prevent tampering with the contents of the container.

44. The flexible sealing cover of claim 40, wherein said metallic foil is a dead soft foil.

45. The flexible multilayered sealing cover of claim 31, wherein said means for tearing the cover comprises four tear lines, two of said tear lines being aligned on each side of the adhesive free region so that as the pull tab region is lifted to remove the sealing cover, the tear lines direct the tear along two parallel lines on opposite sides of the adhesive free region to uncover the injectable membrane so that the protrusions on the center portion and end portions remain on the port to indicate that the cover has been removed.

46. A flexible sealing cover for resealing the side injection port of a pharmaceutical container, the port having a cylindrical portion extending from the container, an annular rim and an injectable membrane with the rim, said sealing cover comprising:

a cover region having a first end portion and a second end portion and a center portion between said first and second end portions, said cover region including:

a first layer of flexible plastic material forming an upper surface of the cover region, said first layer being substantially impermeable to moisture and bacteria;

a second layer of a flexible film material forming a next layer of the cover region, said material being plastically deformable under stress;

a third layer of flexible plastic material forming a lower surface of the cover region;

said first, second and third layers being joined together to join a laminated flexible cover seal;

an area of adhesive material bonded to the surface of said third layer for forming an adhesive contact layer for the cover;

a pull tab region extending from one of said end portions;

said center portion having means for defining a nonadhesive area on the cover region for covering the injectable membrane in the side injection port, the adhesive on the cover portion being adhesively secured to the rim of the cylindrical portion about the injectable membrane, said center portion further having first and second protrusions extending from opposite edges thereof between the first and second end portions for folding against the cylindrical portion for adhesive attachment thereto;

each of said first and second end portions being foldable relative to the cover portion so that the adhesive is facing the cylindrical portion and each of said first and second end portions being adapted to be wrapped about part of the periphery of the cylindrical portion for adhesive attachment thereto, the width of the cover region between the cover portion and first and second end portions being relatively narrow to permit the end portions to be folded relative to the cover region without substantial deformation of the cover region while the first and second end portions each have a sufficient width to wrap approximately one half way about the periphery of the cylindrical portion; and at least one tear line formed in the cover region on each side of the nonadhesive area and aligned generally with the pull tab region so that when the pull tab is grasped to remove the cover, the cover will tear along two lines on either side of the injectable membrane to expose the membrane while parts of the cover portion and first and second end portions remain on the container to indicate that the cover has been removed.

47. The flexible sealing cover of claim 46, wherein said means for forming the nonadhesive area is an adhesive sealant applied to the surface of said adhesive material.

48. The flexible sealing cover of claim 46, wherein said means for forming the nonadhesive area is an adhesive material applied in a predetermined pattern to provide adhesive free region on said third layer.

49. The flexible sealing cover of claim 46, wherein said layers are joined by a first adhesive material applied between said first and second layers and a second adhesive material applied between said second and third layers.

50. The flexible sealing cover of claim 49, wherein said first layer is transparent and said first adhesive material includes a dye material for providing color coded indicia relating to the container to which the seal is applied.

51. The flexible sealing cover of claim 49, wherein said first and second adhesive materials are coextensive with said first, second and third layers.

52. The flexible sealing cover of claim 46, wherein said first, second and third layers are joined together by said first and third layers being extruded onto said second layer.

53. The flexible sealing cover of claim 46, wherein said flexible film material is a metallic foil.

54. The flexible sealing cover of claim 53, wherein said metallic foil is aluminum foil.

55. The flexible sealing cover of claim 53, wherein said metallic foil is tempered as a dead soft foil.

56. The flexible sealing cover of claim 53, wherein said metallic foil is tempered as a half hard foil.

57. The flexible sealing cover of claim 53, wherein said metallic foil is tempered as a full hard foil.

58. The flexible sealing cover of claim 46, wherein said first and third layers are a polyester film between 0.00025 and 0.003 inches in thickness and said second layer of metallic foil is between 0.00025 and 0.003 inches in thickness.

59. The flexible sealing cover of claim 46, wherein said first layer is transparent and further comprises:

printing on the surface of said first layer opposed to said second layer, whereby the printing provides some indicia relating to the container to which the seal is applied.

60. The flexible sealing cover of claim 46, wherein said first layer is transparent and further comprising:

printing on the surface of said second layer opposing first layer, whereby some indicia is provided for the container to which the seal is applied.

61. A method of resealing the side injection port of a pharmaceutical container, the port having a cylindrical portion extending from the pharmaceutical container and an injectable membrane at the exposed end of the cylindrical portion, comprising the steps of:

removing a flexible sealing cover adhesively affixed to a carrier liner, said sealing cover having a cover region with one adhesive side and a pull tab region at one end of the cover region, the cover region including a center portion and first and second end portions;

positioning the adhesive side of the cover region on the port so that a nonadhesive area of the adhesive side covers the injectable membrane and the center portion of the cover region is adhesively secured to the port about the injectable membrane;

folding the first and second end portions of the cover region relative to the center portion, the first and second end portions extending from the center portion on opposites thereof, the first and second end portions being folded against the cylindrical portion of the port;

wrapping the end portions about a segment of the periphery of the cylindrical portion to adhesively secure the end portions to the port to enhance the attachment of the sealing cover; and folding first and second protrusions extending from opposite edges of the center portion between the end portions against the cylindrical portion of the port for adhesive attachment thereto.

62. The method of resealing the port of claim 61 further comprising the step of:

coding the sealing cover according to a predetermined code, whereby said sealing cover code visually identifies information about the resealed container.

63. The method of resealing the port of claim 61 further comprising the steps of:

forming at least one tear slit in the cover region on opposite sides of the nonadhesive area with the slits being generally aligned with the length of the pull tab region so that as the pull tab region is lifted to remove the cover, the cover will tear along parallel lines on either side of the nonadhesive area to expose the injectable membrane while causing pieces of the center portion and first and second end portions to remain on the port to indicate the seal has been removed.

64. The method of resealing the port of claim 61 and further comprising the step of:

tamper proofing said sealing cover and container from needle punctures through the cover, said cover including a layer of metallic foil extending across the injectable membrane for revealing needle punctures.

* * * * *